United States Patent [19]

Domoto et al.

[11] 4,092,454

[45] May 30, 1978

[54] NOVEL NONWOVEN FABRIC AND METHOD FOR MANUFACTURING SAME

[75] Inventors: Masahiro Domoto, Toyonaka; Kozo Tsuji, Takatsuki, both of Japan

[73] Assignees: Sumitomo Chemical Company, Limited, Osaka; Hayashibara Biochemical Laboratories, Inc., Okayama, both of Japan

[21] Appl. No.: 690,655

[22] Filed: May 27, 1976

[30] Foreign Application Priority Data

May 29, 1975 Japan ..... 50-64878

[51] Int. Cl.[2] ..... D04H 1/58

[52] U.S. Cl. ..... 428/288; 195/31 P; 427/390 R; 427/392; 427/421; 428/289; 428/532; 428/537

[58] Field of Search ..... 106/213; 195/31 P; 428/288, 532, 537, 289, 290, 533; 427/390 R, 392, 421

[56] References Cited

U.S. PATENT DOCUMENTS

| | | | |
|---|---|---|---|
| 3,784,390 | 1/1974 | Hijiya et al. | 106/213 |
| 3,870,537 | 3/1975 | Hijiya et al. | 195/31 P |
| 3,871,892 | 3/1975 | Hijiya et al. | 106/213 |
| 3,873,333 | 3/1975 | Hijiya et al. | 106/213 |
| 3,888,809 | 6/1975 | Nakashio | 106/213 |
| 3,912,591 | 10/1975 | Kato et al. | 195/31 P |
| 3,932,192 | 1/1976 | Nakashio | 106/213 |
| 3,936,347 | 2/1976 | Nomura | 195/31 P |
| 3,959,009 | 5/1976 | Kato et al. | 195/31 P |

*Primary Examiner*—James J. Bell
*Attorney, Agent, or Firm*—Stevens, Davis, Miller & Mosher

[57] ABSTRACT

Nonwoven fabric having desirable water absorbency and excellent resistances to oils and solvents is obtained by use of pullulan and/or derivatives thereof as binder.

3 Claims, No Drawings

NOVEL NONWOVEN FABRIC AND METHOD FOR MANUFACTURING SAME

This invention relates to nonwoven fabric containing pullulan or derivatives thereof as binder and to the method for manufacturing same.

Suitable binders for nonwoven fabrics have, heretofore, been selected usually from emulsions of water-dispersible synthetic resins and synthetic rubbers including polymers and copolymers such as, for example, polyvinyl acetate, ethylene-vinyl acetate copolymer, polyacrylic esters, polyvinyl chloride, styrene-butadiene copolymer, and acrylonitrile-butadiene copolymer.

In spite of their advantages as a binder, these emulsions, when used in nonwoven fabric, are accompanied by problems of disagreeable odor and toxicity due to remaining unreacted monomer, smoke or toxic gases generated upon disposal or burning, and toxicity of the emulsifier as well as undesirable effect on bond strength of the emulsifier used in polymerization. These problems have become more serious in recent years. Beside such important environmental problems as public nuisance and industrial wastes, safety of nonwoven fabric goods for living creatures has become also a problem of prime importance. For these reasons, there is an earnest public request for the advent of those nonwoven fabrics and binders therefor which are safe for use and give rise to no public nuisance.

In order to meet the above-noted public request, the present inventors conducted various experiments on the method for manufacturing nonwoven fabrics and, particularly, on the binder used therein and, as the result, have accomplished this invention.

An object of this invention is to provide nonwoven fabrics which have sufficient bond strength, are safe for use, and give rise to no public nuisance, and to provide a method for manufacturing such nonwoven fabrics.

Other objects and advantages of this invention will become apparent from the following description.

This invention is characterized by using pullulan or a derivative thereof as binder in manufacturing nonwoven fabrics.

The pullulan used in this invention is a highmolecular-weight linear polymer having the molecular structure,

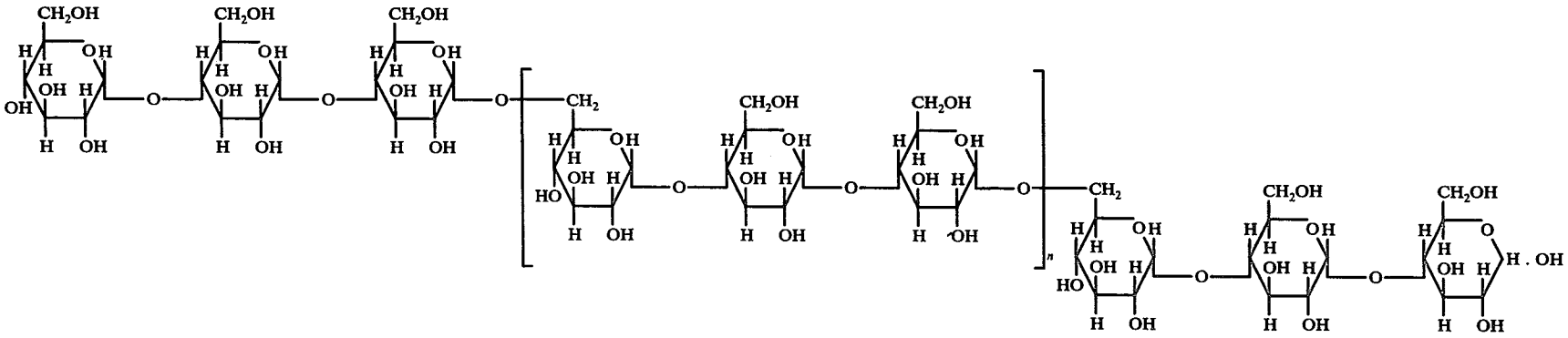

(where $n$ is an integer 20 to 10,000 representing the polymerization degree), in which recurring units of maltotriose, i.e. a trimer of glucose, are joined to one another through $\alpha$-1,6-linkages which are different from the linkages through which glucose units are bonded to one another in the maltotriose unit.

Pullulan has been known only as a tacky substance soluble in water and its properties have scarcely been reported and are still remain substantially unknown. The uses of pullulan have also remained unexploited until recently.

Although pullulan is made up of glucose units, pullulan is quite different not only in molecular configuration but also in properties from glucose derivatives such as starch, oxidized starch, enzymated starch, etherified starch, cationized starch, aminated starch, cellulose, alkylcellulose, hydroxyalkylcellulose, carboxymethylcellulose, gum arabic, and sodium alginate. For example, pullulan is easily soluble in cold water, forming a solution of lower viscosity than those of other water-soluble polymers. Aqueous solutions of pullulan have excellent colloidal stability and show neither gelation nor retrogradation, presenting a striking contrast with starches.

It has been found that characteristic properties of pullulan can be utilized to advantage in manufacturing nonwoven fabrics. Nonwoven fabrics manufactured by use of pullulan as binder manifested a number of unexpected characteristics as shown below.

Pullulan exhibits a high bonding strength to, for example, cellulosic fibers such as pulp, cotton, rayon, and the like. Nonwoven fabrics of cellulosic fibers manufactured by use of pullulan as binder have the following performance characteristics: mechanical strengths are satisfactory with small amounts of pullulan adhered to the fiber; characteristic agreeable feeling of cellulosic fibers is retained, because pullulan used as the binder does not injure the hand or feeling of the fabric, contrary to other binders which give a feeling of incongruity; good visual appearance, desirable water absorbency, and sufficient resistances to oils and solvents. Such a nonwoven fabric exhibits its outstanding performance characteristics when used particularly as a material for the uses where sanitary precaution is of prime importance, such as food packaging, sanitary goods, medical treatment, and household uses. It is also possible to manufacture a flavor-preserving nonwoven fabric by taking advantage of the barrier property of pullulan against gases.

Pullulan, which is used in this invention and plays a principla part, may be produced by any method. For example, it can be isolated and recovered as an extracellular tacky substance on cultivating a strain of the genus Pullularia classified at present under Deuteromycetes (incomplete microorganism). As an example, a strain of *Pullularia pullulans* is inoculated into a medium containing 10% of partially hydrolyzed starch, 0.5% of $K_2HPO_4$, 0.1% of NaCl, 0.02% of $MgSO_4.7H_2O$, 0.06% of $(NH_4)_2SO_4$, and 0.04% of yeast extract and subjected to shaking culture at 24° C for 5 days, whereby pullulan is obtained as an extracellular tacky substance. The culture may be carried out also by use of sucrose or glucose as the carbon source. If necessary, purified pullulan may be obtained by removing cells from the culture liquor by centrifugation and precipitating pullulan with methanol. Although pullulan varies to some degree in properties according to the strain by which it is produced, any pullulan may be used in this invention. Molecular weight of the pullulan used in this invention is not restricted, but is usually 10,000 to 5,000,000, preferably 10,000 to 500,000 in view of manufacturing operation and viscosity of the aqueous solution.

Although pullulan is a desirable binder by itself, derivatives obtained by the reactions customarily used in modifying starches, such as, for example, enzymation, etherification, cationization, amination, carboxymethylation, and carboxylation, also exhibit properties comparable to or, sometimes, even better than those of pullulan when used as binder. Pullulan and derivatives can be used in combinations of two or more. The carboxylated pullulan as herein referred to is a derivative in which the primary hydroxyl groups of pullulan have been transformed to carboxyl groups by oxidation of an aqueous solution of pullulan with an oxidizing agent such as fuming nitric acid, etc. Pullulan and its derivatives can be used jointly with other binders such as natural or synthetic rubber latices, synthetic resin emulsions, starches, etc., which are customarily used in conventional nonwoven fabrics.

The principal steps in manufacturing nonwoven fabrics according to this invention are a web forming step and a succeeding step of impregnating the web with a binder, as described below in detail.

The web-forming materials used in this invention are chemical, synthetic, and natural fibers such as rayon, "Tetoron", nylon acetate, "Vinylon", polyvinyl chloride, pulp, and cotton. These materials in the form of staple fiber are made into web in the air by means of a web forming machine such as Random Webber or Duform Webber in a manner similar to that in the manufacture of conventional nonwoven fabrics. The web thus formed is then applied with an aqueous solution or dispersion of pullulan or derivatives thereof by impregnation, coating, or spraying in a manner similar to that in the manufacture of conventional nonwoven fabrics.

The concentration of pullulan in the aqueous solution or dispersion is preferably about 3 to 50% by weight in view of control and uniformity of the quality of end products. The suitable amount of binder to be adhered to the web, that is, the amount of pullulan and/or derivatives thereof to be contained in the nonwoven fabric, is 5 to 150%, preferably 10 to 60% by weight of "dry pick-up" depending upon the required performance characteristics of the resulting nonwoven fabric. The term "dry pick-up" as used above means the ratio of pullulan and/or derivatives thereof to nonwoven fabric represented by the equation below:

$$\frac{\text{Weight of pullulan and/or derivatives thereof as binder}}{\text{Weight of nonwoven fabric}} \times 100\ (\%)$$

As mentioned above, the impregnated web is dried by the conventional manner. Said impregnated web is further subjected to heat-treatment at a temperature of 70° to 200° C for 0.5 to 5 minutes if necessary.

In case of an emulsion-type polymer which has usually been used as binder, there often occurs unevenness of the amount of binder contained in nonwoven fabric at drying step after impregnation. This trouble can be overcome in some extent by using a water-soluble binder. When a conventional water-soluble binder is used, however, in order to increase the strength of nonwoven fabric, it becomes necessary to make a concentration of binder in the solution high thereby to increase the amount of binder to be adhered. As a result, there occurs such trouble that the impregnating property of the binder into the nonwoven fabric becomes low.

On the contrary, when pullulan and/or derivatives thereof is used as binder as in case of the present invention, the impregnation of binder into nonwoven fabric can be very smoothly carried out because of low viscosity of the solution even at a relatively high concentration, addition to the excellency in adhesiveness.

The nonwoven fabrics obtained according to the method of this invention may be used as the material for clothing, interlinings, filter cloths, sanitary goods, packaging, etc.

The invention is illustrated below with reference to Examples.

EXAMPLE 1

A nonwoven web of 100% rayon was impregnated with a 5-% aqueous solution of pullulan having a molecular weight of 150,000, prepared in the customary way, to obtain a nonwoven fabric of a basis weight of 30 g/m$^2$ containing 10% of "Dry pick-up" of the binder. The impregnated web was dried at 150° C for 48 seconds and then heat-treated at 150° C for one minute. The resulting nowoven fabric had a high bond strength, excellent resistances to oils and solvents and was easily dispersible in water, and recovery of the used fibers was easy. This nonwoven fabric had properties suitable for use in food packaging or as a wiper cloth for domestic use. Performance characteristics were as shown in Table 1.

Table 1

| | | | Fibers used: 100% rayon; dry pick up: 10% | | | |
|---|---|---|---|---|---|---|
| | | | Solvent resistance (Triclene) | | Oil resistance (Salad oil) | |
| Tensile strength (KGSC value)** | Water absorbency | Dispersibility in water (20° C) | Tensile strength (KGSC value)** | Percent* leached | Tensile strength (KGSC value)** | Percent* leached |
| 163 | Very good | <30 sec. | 115 | 0 | 126 | 0 |

Note:
*Percent leached: Weight change in % of test specimen after immersion at room temperature for 20 minutes.
**KGSC value: [(kg/cm)/(g/cm$^2$)] measured by the method according to JIS L-1085.

EXAMPLE 2

The pullulan used in Example 1 was modified in the following way to obtain carboxylated pullulan.

To 125 ml of fuming nitric acid in a 1-liter round bottom flask, was added 125 ml of water. To the resulting solution maintained at 18° C, was added 25 g of pullulan (molecular weight: 360,000) and the resulting mixture was stirred for 3 hours to allow the reaction to proceed. The reaction mixture was poured into one liter of methanol to precipitate carboxylated pullulan. The oxidized pullulan was again dissolved in water and re-precipitated with methanol. The precipitates were collected by vacuum filtration, washed with methanol, then with ether, and dried over calcium chloride. The carboxyl group content of the carboxylated pullulan thus obtained was about 2% by weight.

To an aqueous solution containing 5% of the carboxylated pullaln, was added 0.5% of an aqueous solution containing 80% of trimethylolmelamine to obtain a binder solution. A nonwoven web of 100% rayon was impregnated with the above binder solution to obtain a nonwoven web, 30 g/m$^2$ in basis weight, containing 10% of Dry pick-up of the binder. The impregnated web was heat-treated at 150° C for 100 seconds. The resulting nonwoven fabric was resistant to water, contary to the nonwoven fabric obtained in Example 1, which was easily dispersible in water. After immersion in water at room temperature for 10 minutes, the above nonwoven fabric showed a wet tensile strength of 60 [KGSC value], while the nonwoven fabric obtained in Example 1 showed a corresponding value of substantially zero.

What is claimed is:

1. A nonwoven fabric comprising fibers of a material selected from the group consisting of rayon, cotton, pulp, Tetoron, nylon, acetate, vinylon, and polyvinyl chloride and, as a binder, pullulan having a molecular weight of 10,000 to 5,000,000, its enzymated, etherified, cationized, aminated, carboxymethylated or carboxylated derivatives, or mixture thereof, said binder being used in an amount of 5 to 150% of dry pick up.

2. A method for manufacturing a nonwoven fabric, which comprises applying to a web made of fibers of a material selected from the group consisting of rayon, cotton, pulp, Tetoron, nylon, acetate, vinylon, and polyvinyl chloride an aqueous solution or dispersion containing pullulan having a molecular weight of 10,000 to 5,000,000, its enzymated, etherified, cationized, aminated, carboxymethylated, or carboxylated derivatives, or mixture thereof by impregnation, coating, or spraying, and then heat-treating the web at 70° C to 200° C for 0.5 to 5 minutes.

3. An improved nonwoven fabric consisting essentially of rayon, pulp, Tetoron, acetate, vinylon, or polyvinyl chloride fibers which is binded with a binder, wherein the improvement comprises using as the binder pullulan having a molecular weight of 10,000 to 5,000,000, its enzymated, etherified, cationized, aminated, carboxymethylated, or carboxylated derivatives, or mixture thereof.

* * * * *